US007204095B2

(12) United States Patent
Jeong et al.

(10) Patent No.: US 7,204,095 B2
(45) Date of Patent: Apr. 17, 2007

(54) REFRIGERATOR

(75) Inventors: Bu-kil Jeong, Kwanglu (KR); Eui-young Chang, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 104 days.

(21) Appl. No.: 10/821,188

(22) Filed: Apr. 9, 2004

(65) Prior Publication Data

US 2005/0138952 A1 Jun. 30, 2005

(30) Foreign Application Priority Data

Dec. 31, 2003 (KR) ..... 10-2003-0102155

(51) Int. Cl.
*F25D 17/04* (2006.01)

(52) U.S. Cl. ..... 62/408; 62/186

(58) Field of Classification Search ..... 62/408, 62/187, 407, 186, 89, 440, 412, 414
See application file for complete search history.

(56) References Cited

U.S. PATENT DOCUMENTS

| | | | | |
|---|---|---|---|---|
| 5,081,850 | A | 1/1992 | Wakatsuki et al. | |
| 5,584,191 | A | 12/1996 | Kwon | |
| 5,664,437 | A * | 9/1997 | Park et al. | 62/407 |
| 5,678,413 | A * | 10/1997 | Jeong et al. | 62/89 |
| 5,729,997 | A * | 3/1998 | Witsoe | 62/407 |
| 5,775,124 | A * | 7/1998 | Park et al. | 62/408 |
| 5,802,867 | A * | 9/1998 | Kang | 62/408 |
| 6,044,654 | A * | 4/2000 | Igari et al. | 62/186 |
| 6,055,820 | A * | 5/2000 | Jeong et al. | 62/186 |
| 6,131,403 | A * | 10/2000 | Ji | 62/186 |
| 6,497,113 | B1 * | 12/2002 | Yamada et al. | 62/441 |
| 2004/0139763 | A1 * | 7/2004 | Jeong et al. | 62/448 |

FOREIGN PATENT DOCUMENTS

| | | |
|---|---|---|
| CN | 1401958 A | 3/2003 |
| JP | 2002-174480 | 6/2002 |
| JP | 2002-257454 | 9/2002 |
| JP | 2002-257455 | 9/2002 |
| JP | 2002-295951 | 10/2002 |

(Continued)

OTHER PUBLICATIONS

Chinese Office Action for corresponding Chinese Application No. 200410042185.9 dated Apr. 7, 2006.

*Primary Examiner*—Cheryl Tyler
*Assistant Examiner*—Michael J. Early
(74) *Attorney, Agent, or Firm*—Staas & Halsey LLP

(57) ABSTRACT

A refrigerator which includes a main body having a freezing compartment and a refrigerating compartment, an evaporating unit provided in the main body, and a first duct and a second duct in communication with the evaporating unit to guide cooling air generated from the evaporating unit to the freezing compartment and the refrigerating compartment of the main body, respectively, wherein the second duct is provided around a edge of a rear of the refrigerating compartment of the main body and having a cooling air supply hole to supply the cooling air to the refrigerating compartment. Thus, according to the present invention, the cooling air is supplied from the edge of the rear of the refrigerating compartment, thereby providing the duct of a simple structure and facilitating a refrigerating efficiency.

21 Claims, 5 Drawing Sheets

FOREIGN PATENT DOCUMENTS

| | | |
|---|---|---|
| JP | 2002-340466 | 11/2002 |
| JP | 2003-75055 | 3/2003 |
| KR | 1997-10598 | 3/1997 |
| KR | 1998-52951 | 9/1998 |
| KR | 1999-39321 | 11/1999 |
| KR | 10-286036 | 1/2001 |
| KR | 2003-18830 | 3/2003 |
| KR | 2003-18834 | 3/2003 |
| KR | 2003-18836 | 3/2003 |
| KR | 2003-42758 | 6/2003 |

* cited by examiner

REFRIGERATOR

CROSS-REFERENCE TO RELATED APPLICATIONS

This application claims the benefit of Korean Patent Application No. 2003-102155, filed on Dec. 31, 2003, in the Korean Intellectual Property Office, the disclosure of which is incorporated herein by reference.

BACKGROUND OF THE INVENTION

1. Field of the Invention

The present invention relates to a refrigerator, and more particularly, to a refrigerator in which cooling air generated from an evaporating unit is supplied to a freezing compartment and a refrigerating compartment through a duct to keep a uniform temperature distribution in the refrigerator.

2. Description of the Related Art

A refrigerator keeps food fresh for a long time by using cooling air heat-exchanged from an evaporating unit of a freezing cycle.

The refrigerator includes a duct in communication with a freezing compartment and a refrigerating compartment to supply cooling air to and circulate the cooling air inside of the freezing compartment and a refrigerating compartment.

A conventional refrigerator includes a main body having a refrigerating compartment and a freezing compartment, a door provided on openings of the refrigerating compartment and the freezing compartment of the main body to open/close the openings, an evaporating unit provided in the main body, and first and second ducts in communication with the evaporating unit to guide cooling air to the refrigerating compartment and the freezing compartment of the main body, respectively. Recently, an independent refrigerating method in which an evaporating unit is provided in each of the refrigerating compartment and a freezing compartment has been used to facilitate a refrigerating efficiency.

The conventional refrigerator has an advantage to facilitate the refrigerating efficiency, but a disadvantage of a high cost for two of the evaporating units. Further, the conventional refrigerator requires more space for two of the evaporating units, which increases a volume of the refrigerator and decreases a space to store food in the refrigerator.

On the other hand, in a refrigerator having only one evaporating unit, a duct to guide cooling air to the refrigerating compartment has been provided mainly on a rear or a side of the refrigerating compartment. Thus, cooling air is not supplied to an edge of the refrigerating compartment, which causes a difficulty to obtain a uniform temperature distribution. To solve the problem, a plurality of ducts is necessary.

SUMMARY OF THE INVENTION

Accordingly, it is an aspect of the present invention to provide a refrigerator that comprises a simple structure of a duct and keeps a uniform temperature distribution in a refrigerating compartment.

Additional aspects and/or advantages of the invention will be set forth in part in the description which follows and, in part, will be obvious from the description, or may be learned by practice of the invention.

The foregoing and/or other aspects of the present invention are achieved by providing refrigerator comprising a main body comprising a freezing compartment and a refrigerating compartment, an evaporating unit in the main body, and a first duct and a second duct in communication with the evaporating unit to guide cooling air generated from the evaporating unit to the freezing compartment and the refrigerating compartment of the main body, respectively, wherein the second duct is provided around an edge of a rear of the refrigerating compartment of the main body and comprises a cooling air supply hole to supply the cooling air to the refrigerating compartment.

According to an aspect of the invention, the second duct further comprises a main duct which is provided at an upper part of the edge of the refrigerating compartment and to which the cooling air is supplied from the evaporating unit, and side ducts in communication with the main duct and provided on opposite sides of the edge of the refrigerating compartment and having a side cooling air supply hole, respectively.

According to an aspect of the invention, the refrigerator further comprises a damper provided inside of the main duct.

According to an aspect of the invention, the main duct comprises a first cooling air channel and a second cooling air channel on an inside thereof, to guide the cooling air to the side ducts.

According to an aspect of the invention, the main duct further comprises a main cooling air supply hole at opposite sides of a front side thereof, and a third cooling air channel on the inside thereof, to guide the cooling air to the main cooling air supply hole.

According to an aspect of the invention, the refrigerator further comprises a lamp disposed on the main duct as a single body with the main duct.

According to an aspect of the invention, the side ducts extend to a lower part of the refrigerating compartment.

According to an aspect of the invention, the refrigerator further comprises a guide duct in communication with the evaporating unit to supply the cooling air to the first and second ducts.

BRIEF DESCRIPTION OF THE DRAWINGS

These and/or other aspects and advantages of the invention will become apparent and more readily appreciated from the following description of the embodiments, taken in conjunction with the accompany drawings of which.

DETAILED DESCRIPTION OF THE PREFERRED EMBODIMENTS

Figure 1:
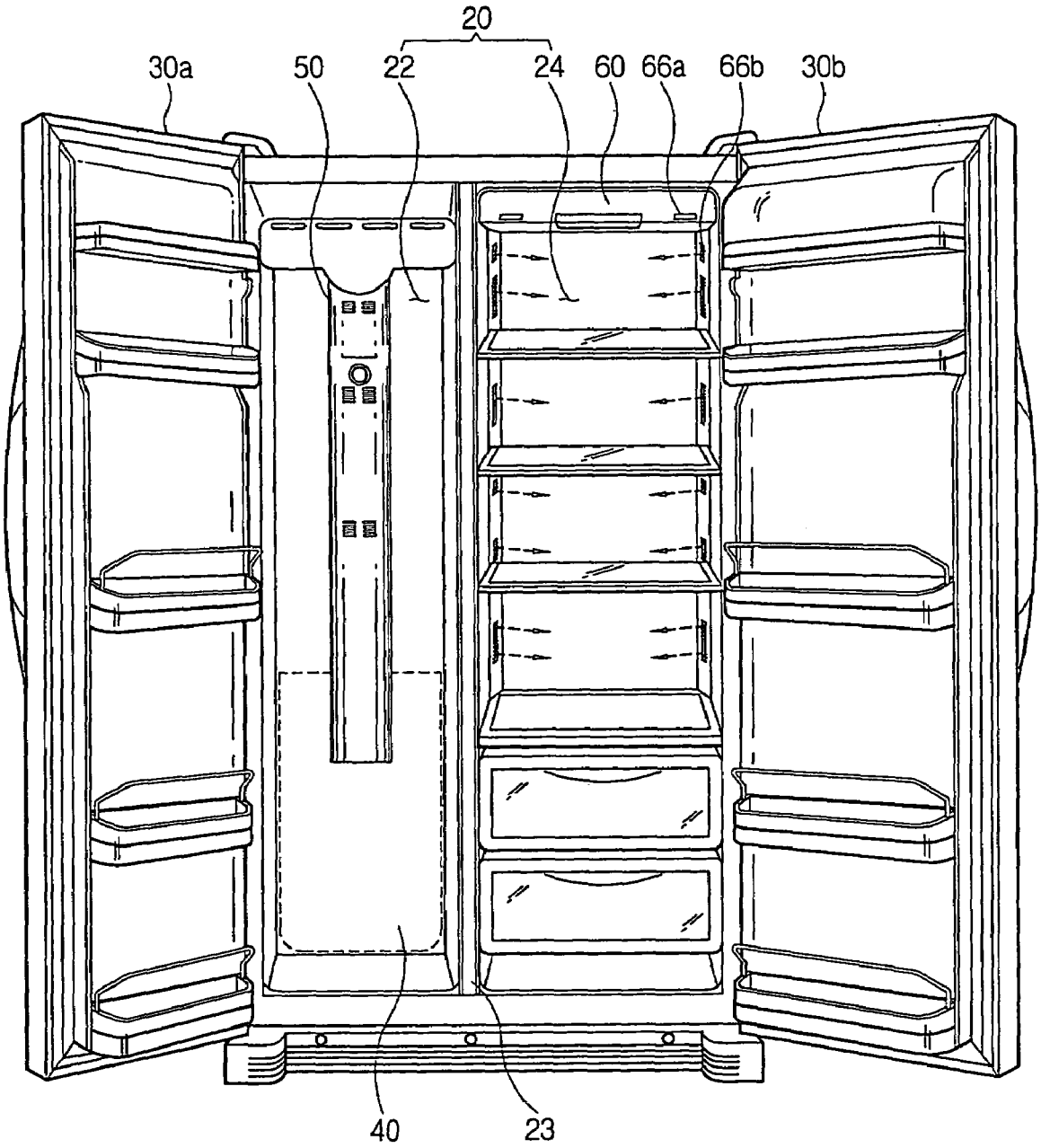
FIG. 1 is a perspective view of a refrigerator according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

In FIG. 1, a refrigerator according to an embodiment of the present invention comprises a main body 20 divided into a freezing compartment 22 and a refrigerating compartment 24 by partitions 23, doors 30*a* and 30*b* provided on openings of the freezing compartment 22 and the refrigerating compartment 24 to open/close the openings, an evaporating unit 40 provided in the main body 20, and first and second ducts 50 and 60 communicated with the evaporating unit 40, to guide cooling air to the freezing compartment 22 and the refrigerating compartment 24, respectively.

According to an aspect of the present invention, the main body 20 may be a "side by side" structure in which the freezing compartment 22 and the refrigerating compartment 24 are disposed at right and left sides. According to an aspect of the present invention, the doors 30*a* and 30*b* may be hingedly connected to the freezing compartment 22 and the refrigerating compartment 24 to rotatably open/close the openings of the freezing compartment 22 and the refrigerating compartment 24 as selected.

The evaporating unit 40 supplies cooling air to keep the freezing compartment 22 and the refrigerating compartment 24 at a predetermined temperature. The evaporating unit 40 is provided at a rear of the freezing compartment 22 to provide a wider space for storing food and connected to the first and second ducts 50 and 60. The evaporating unit 40 may be variously positioned as required.

The evaporating unit 40 comprises an evaporator (not shown) to generate cooling air by heat exchange, and a fan (not shown) provided in the vicinity of the evaporator to send the cooling air generated from the evaporator to the first and second ducts 50 and 60.

The first and second ducts 50 and 60 each comprise a cooling air channel, respectively, which guides the cooling air generated from the evaporating unit 40 to insides of the freezing compartment 22 and the refrigerating compartment 24. Especially, the second duct 60 is provided around an edge of a rear of the refrigerating compartment 24 to supply the cooling air from the edge of the rear of the refrigerating compartment 24 and comprises cooling air supply holes 66*a* and 66*b* in communication with the refrigerating compartment 24. Thus, a refrigerating efficiency of the refrigerating compartment 24 increases and a uniform temperature distribution is obtained.

Figure 2:
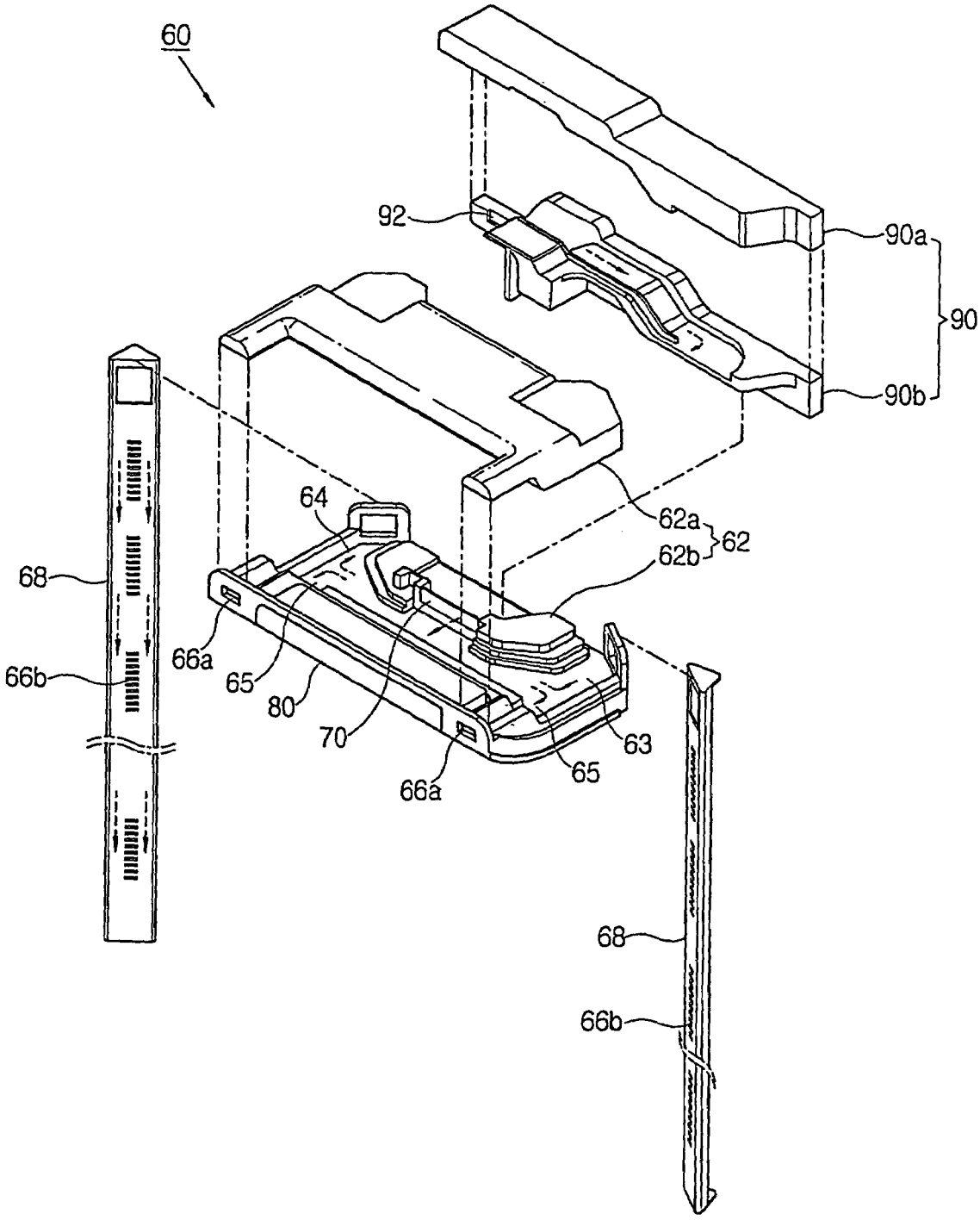
FIG. 2 is an exploded perspective view illustrating a second duct of the refrigerator shown in FIG. 1.
Figure 3:
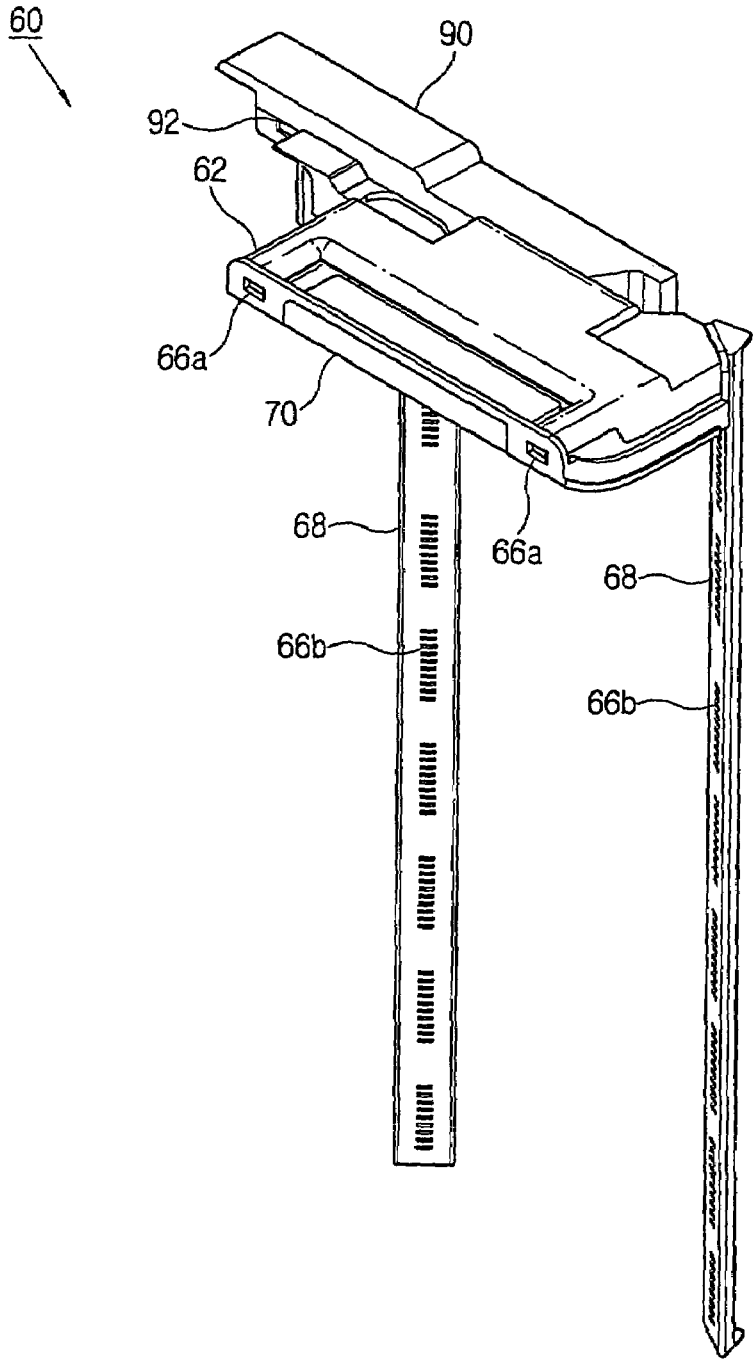
FIG. 3 is a combined perspective view of the second duct as shown in FIG. 2.
Figure 4:
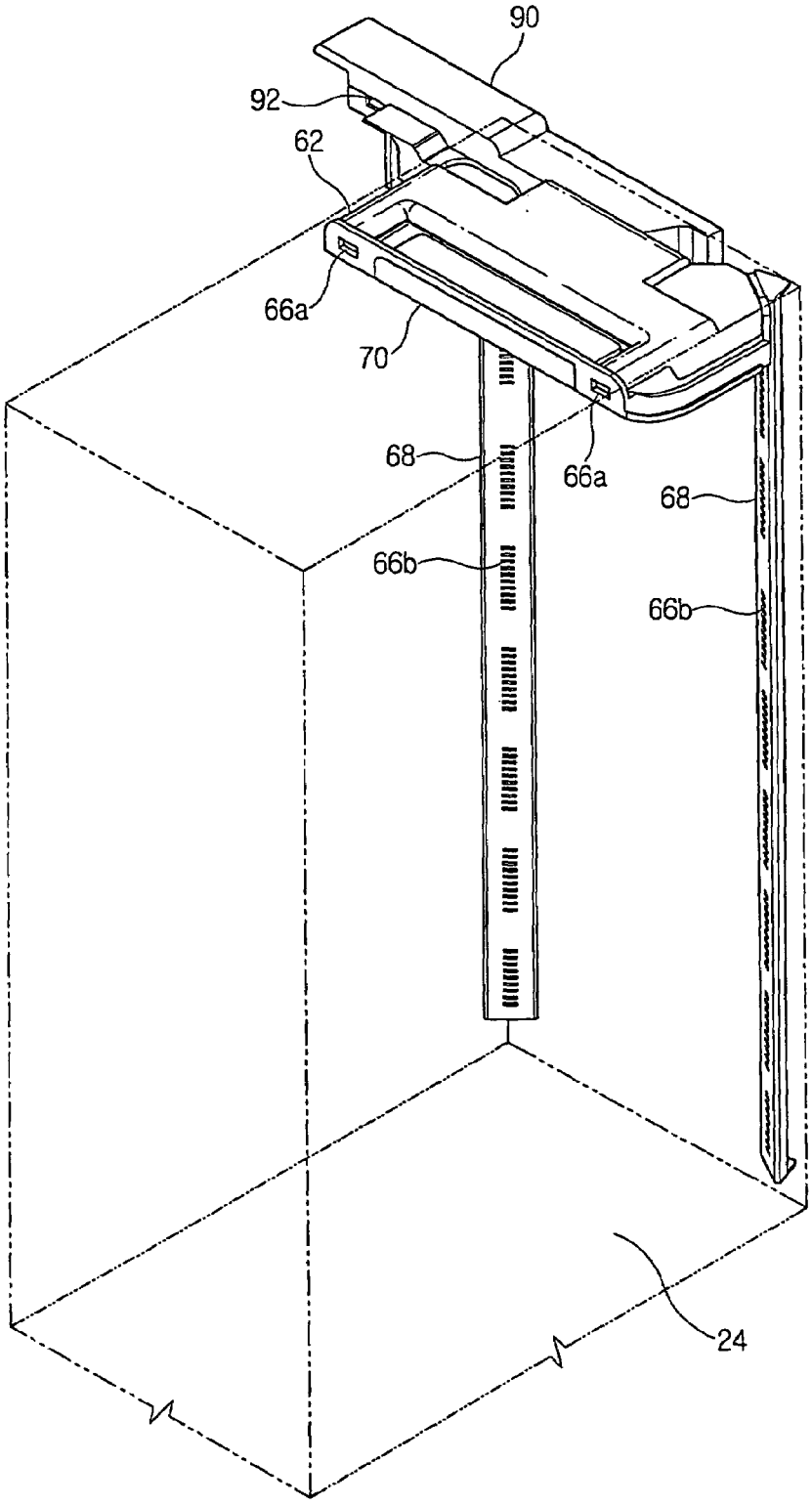
FIG. 4 is a partial perspective view illustrating the second duct mounted in a refrigerating compartment of the refrigerator as shown in FIG. 1.
Figure 5:
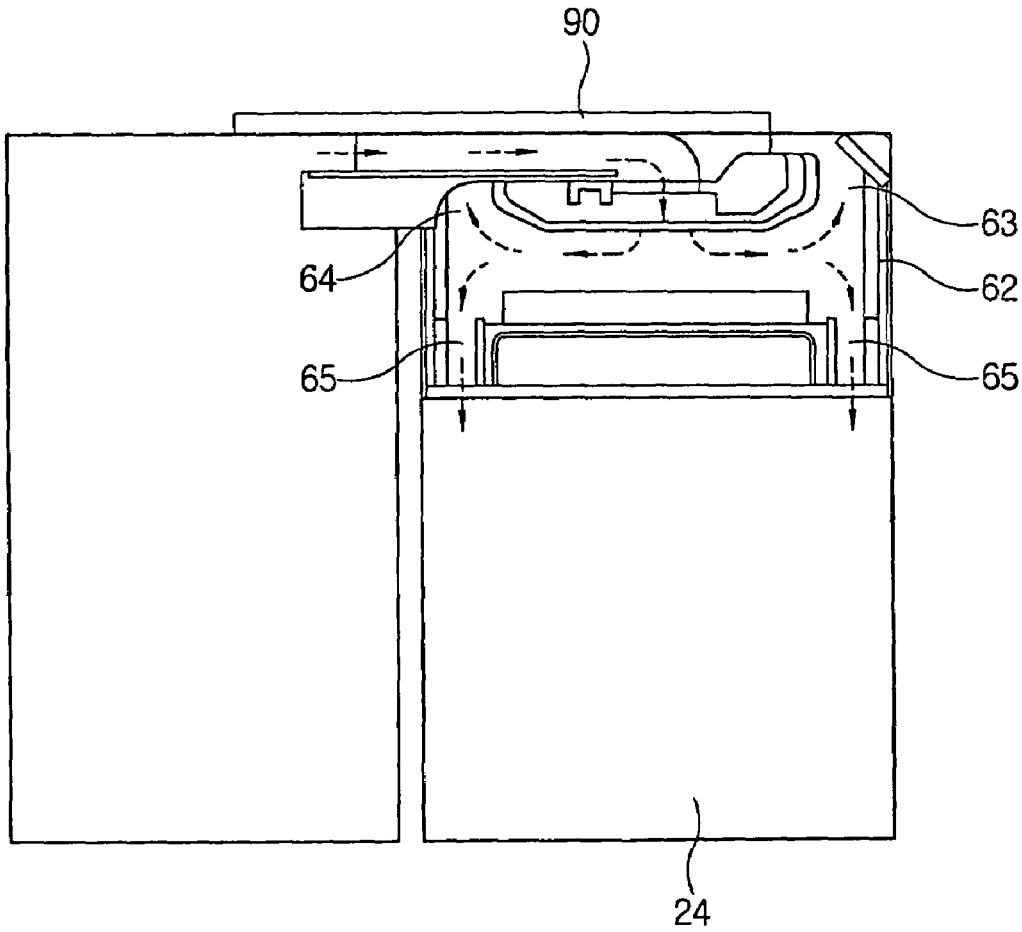
FIG. 5 is a plane view illustrating a flow of cooling air supplied to the refrigerating compartment of the refrigerator as shown in FIG. 1.

In FIGS. 2 through 4, the second duct 60 of the refrigerator according to the embodiment of the present invention further comprises a main duct 62 which is provided on an upper part of the edge of the refrigerating compartment 24, and to which the cooling air is supplied from the evaporating unit 40, and side ducts 68 in communication with the main duct 62 and provided on sides of the edge of the refrigerating compartment 24 and having a plurality of side cooling air supply holes 66*b*.

The main duct 62 comprises a damper 70 to adjust the quantity of cooling air flowing into the refrigerating compartment 24. A variety of dampers may be used as selected. However, as an aspect of the present invention, an electromotive damper may be used. A detailed description of the electromotive damper is not provided, as it is a prior art.

The main duct 62 further comprises an upper cover 62*a* and a lower cover 62*b*, connected to each other to form first and second cooling air channels 63 and 64 to guide the cooling air to the side ducts 68. As an aspect of the present invention, the damper 70 may be provided at a position where the first and second cooling air channels 63 are not divided yet. The damper 70 may be variously positioned as long as the quantity of the cooling air supplied to the refrigerating compartment 24 can be adjusted.

The main duct 62 further comprises main cooling air supply holes 66*a* on opposite sides of a front side thereof, to supply the cooling air to an upper front of the refrigerating compartment 24. The main duct 62 further comprises a third cooling air channel 65 on an inside thereof, to guide the cooling air to the main cooling air supply holes 66*a*.

The side ducts 68 are bar shaped and extend to a lower part of the refrigerating compartment 24 to rapidly cool the refrigerating compartment 24 and obtain a uniform temperature distribution. Shapes and sizes of the side ducts 68 may be varied as required, a structure and a position of the side cooling air supply hole 66*b* may be varied as well.

The main duct 62 further comprises a lamp 80 on a front surface thereof, to illuminate the refrigerating compartment 24 as a single body with the main duct 62, which saves space to dispose the lamp 80.

A guide duct 90 is disposed between the evaporating unit 40, the first duct 50 and the second duct 60 in communication with the evaporating unit 40, the first duct 50 and the second duct 60, to supply and distribute the cooling air generated from the evaporating unit 40 to the first and second units 50 and 60. The guide duct 90 comprises a connecting hole 92 on a side thereof, connected to the first duct 50. Like the main duct 62, the guide duct 90 comprises an upper cover 90*a* and a lower cover 90*b*, which are connected to each other to form a cooling air channel in communication with the main duct 62.

According to a configuration as described above, a description of a flow of the cooling air follows.

First, cooling air generated from the evaporating unit 40 passes the guide duct 90 to be guided to the first duct 50 and the second duct 60, respectively. The cooling air guided to a rear of the refrigerating compartment 24 through the guide duct 90 flows into the main duct 62 in communication with the guide duct 90.

The cooling air flowing into the main duct 62 is guided to the side duct 68 through the first and second cooling air channels 63 and 64 and at the same time to a front side of the main duct 62 through the third cooling air channel 65.

The cooling air guided to the side ducts 68 is supplied from the upper part of the rear edge of the refrigerating compartment 24 through the side cooling air supply hole 66*b*. The cooling air guided to the front side of the main duct 62 is supplied from the opposite sides of the edge of the rear of the refrigerating compartment 24 through the main cooling air supply hole 66*a*, which keeps the temperature distribution in the refrigerating compartment 24 uniform.

As described above, according to the present invention, the cooling air is supplied from the edge of the rear of the refrigerating compartment, thereby providing the duct of a simple structure and facilitating a refrigerating efficiency.

Further, since only one evaporating unit is used in the refrigerator according to the present invention, cost for mounting the duct is decreased.

Although a few embodiments of the present invention have been shown and described, it will be appreciated by those skilled in the art that changes may be made in this embodiment without departing from the principles and spirit of the invention, the scope of which is defined in the claims and their equivalents.

What is claimed is:

1. A refrigerator comprising:

a main body comprising a freezing compartment and a refrigerating compartment;

an evaporating unit provided in the main body;

a first duct and a second duct in communication with the evaporating unit to guide cooling air generated from the evaporating unit to the freezing compartment and the refrigerating compartment of the main body, respectively, the second duct being positioned at a top portion of the refrigerating compartment of the main body and comprising a main duct provided at the top portion of the refrigerating compartment and to which the cooling air is supplied from the evaporating unit and a cooling air supply hole to supply the cooling air to the refrigerating; and a guide duct in communication with the evaporating unit and the first and second ducts, the guide duct provided at a top portion of the refrigerating compartment to supply the cooling air to the first and second ducts, respectively.

2. The refrigerator of claim 1, wherein the second duct further comprises:

side ducts in communication with the main duct and provided on opposite sides of the edge of the refrigerating compartment perpendicular to the main duct, and comprising a side cooling air supply hole, respectively.

3. The refrigerator of claim 2, further comprising a damper provided inside of the main duct to adjust a quantity of the cooling air flowing into the refrigerating compartment.

4. The refrigerator of claim 3, wherein the main duct further comprises a first cooling air channel and a second cooling air channel on the inside thereof, to guide the cooling air to the side ducts.

5. The refrigerator of claim 2, wherein the main duct further comprises:

a main cooling air supply hole on opposite sides of a front side thereof, and a cooling air channel on the inside thereof, to guide the cooling air to the main cooling air supply hole.

6. The refrigerator of claim 5, further comprising a lamp disposed on the main duct as a single body with the main duct.

7. The refrigerator of claim 2, wherein the side ducts extend to a lower part of the refrigerating compartment.

8. The refrigerator of claim 3, wherein the main duct further comprises:

a main cooling air supply hole on opposite sides of a front side thereof, and a cooling air channel on the inside thereof, to guide the cooling air to the main cooling air supply hole.

9. The refrigerator of claim 8, further comprising a lamp disposed on the main duct as a single body with the main duct.

10. The refrigerator of claim 3, wherein the side ducts extend to a lower part of the .refrigerating compartment.

11. The refrigerator of claim 4, wherein the main duct further comprises:

a main cooling air supply hole on opposite sides of a front side thereof, and a third cooling air channel on the inside thereof, to guide the cooling air to the main cooling air supply hole.

12. The refrigerator of claim 11, further comprising a lamp disposed on the main duct as a single body with the main duct.

13. The refrigerator of claim 4, wherein the side ducts extend to a lower part of the refrigerating compartment.

14. The refrigerator of claim 2, wherein the cooling air supplied to the side ducts is supplied from the upper part of the edge of the rear of the refrigerating compartment through the side cooling air supply hole and cooling air guided to a front side of the main duct is supplied from the opposite sides of the edge of the rear of the refrigerating compartment through the cooling air supply hole to keep the temperature distribution in the refrigerating compartment uniform.

15. The refrigerator of claim 11, wherein the cooling air flowing into the main duct is guided to the side ducts through the first and second cooling channels and to a front side of the main duct through the third cooling air channel, simultaneously.

16. The refrigerator of claim 14, wherein the guide duct comprises a connecting hole on a side thereof, connected to the first ducts and an upper and a lower cover connected to each other to form a cooling air channel with the second duct.

17. A refrigerator comprising:

a freezing compartment and a refrigerating compartment to store food therein;

an evaporating unit to generate cooling air in the refrigerator;

a plurality of ducts in communication with the evaporating unit to guide the cooling air into the freezing compartment and the refrigerating compartment, respectively, wherein the plurality of ducts are provided at a rear of the refrigerator and comprise cooling air supply holes to supply cooling air into the refrigerator, wherein the plurality of ducts comprise a duct positioned at a top portion of the refrigerating compartment to supply cool air to an upper part of the refrigerating compartment; and a guide duct in communication with the evaporating unit and the plurality of ducts, the guide duct provided at a top portion of the refrigerating compartment to supply the cooling air to the plurality of ducts, respectively.

18. The refrigerator of claim 17, wherein the plurality of ducts further comprise side ducts provided on opposite sides of the refrigerating compartment perpendicular to the duct positioned at the top portion of the refrigerating compartment.

19. The refrigerator of claim 17, further comprising a lamp disposed on a front surface of the duct, to illuminate the refrigerating compartment.

20. The refrigerator of claim 17, wherein the guide duct comprises a connecting hole on a side thereof, to be connected to one of the plurality of ducts.

21. The refrigerator of claim 18, wherein the side ducts are bar shaped and extend to a lower portion of the refrigerating compartment to cool the refrigerating compartment and maintain a uniform temperature distribution.

* * * * *

UNITED STATES PATENT AND TRADEMARK OFFICE

CERTIFICATE OF CORRECTION

PATENT NO. : 7,204,095 B2
APPLICATION NO. : 10/821188
DATED : April 17, 2007
INVENTOR(S) : Bu-kil Jeong et al.

It is certified that error appears in the above-identified patent and that said Letters Patent is hereby corrected as shown below:

Column 5, Line 9-10, change “refrigerating;” to --refrigerating compartment;--.

Column 5, Line 51, change “.refrigerating” to --refrigerating--.

Column 6, Line 18, change “ducts” to --duct,--.

Signed and Sealed this

Thirty-first Day of July, 2007

JON W. DUDAS
*Director of the United States Patent and Trademark Office*